US005311670A

United States Patent [19]

Tomoiaga

[11] Patent Number: 5,311,670

[45] Date of Patent: May 17, 1994

[54] SHINGLE ALIGNMENT TOOL

[75] Inventor: Ioan Tomoiaga, 1025 W. Prospect Rd. #6, Fort Lauderdale, Fla. 33309

[73] Assignees: Peter Bejusca; Ioan Tomoiaga, Fort Lauderdale, Fla.

[21] Appl. No.: 42,730

[22] Filed: Apr. 5, 1993

[51] Int. Cl.[5] ..... G01D 21/00

[52] U.S. Cl. ..... 33/648

[58] Field of Search ..... 33/646, 647, 648, 649

[56] References Cited

U.S. PATENT DOCUMENTS

| | | | |
|---|---|---|---|
| 154,522 | 8/1874 | Schramm | 33/648 |
| 383,597 | 5/1888 | Slane | 33/648 |
| 693,054 | 2/1902 | Nelson | 33/649 |
| 738,256 | 9/1903 | Tinklepaugh | 33/648 |
| 920,941 | 5/1909 | Filkin | 33/648 |
| 952,772 | 3/1910 | Webster | 33/648 |
| 1,210,469 | 1/1971 | Harshberger | 33/648 |
| 1,414,556 | 5/1922 | Dresen | 33/649 |
| 1,504,635 | 8/1924 | McCausland | 33/648 |
| 1,645,808 | 10/1927 | Gregel | 33/648 |
| 4,110,911 | 9/1978 | Sucheck | 33/648 |

OTHER PUBLICATIONS

Popular Mechanics, p. 212, vol. 105, No. 3 Mar. 1956.

*Primary Examiner*—Thomas B. Will

*Attorney, Agent, or Firm*—Malin, Haley, DiMaggio & Crosby

[57] ABSTRACT

An alignment tool for use by a shingle installer for aligning a row of shingles to be fastened to a roof, the shingles having straight bottom edges relative to a previously fastened row of shingles. The alignment tool includes a pair of flanged brackets that fit snugly against the lower edge of the already fastened shingles and includes an upper edge that allows the shingles to be fastened to be quickly placed thereagainst for proper alignment. The installer can kneel, holding the alignment tool in position while actually fastening the shingles to the roof with his free hands.

4 Claims, 3 Drawing Sheets 12
14
14a
16
16a
24

SHINGLE ALIGNMENT TOOL

BACKGROUND OF THE INVENTION

1. Field of the Invention

This invention relates generally to a tool that provides for precise alignment of a row layer of rectangular roof shingles expeditiously and accurately, and in particular, to a shingle alignment tool that utilizes a kneeling platform used by the shingle applicator that allows for alignment and nailing or stapling of the shingles in a coordinated movement.

2. Description of the Prior Art

The use of asphalt or asphalt-like, rectangular (typically one foot by three feet), overlapping shingles for roofs is well known. The shingles are constructed in one piece in elongated strips 3 ft. long, having spaced lateral separations with the edges being shaped like rectangles along one side, and a continuous shingle body along the top edge where the shingle is attached by nails or staples to a typically plywood roof that is covered with tar paper. Perhaps the most time consuming aspect of applying shingles to the roof is the vertical alignment thereof so that the bottom lower edges of the shingles are properly spaced relative to the previously attached row of shingles, there being a precise distance of overlap required for proper alignment, and assuring that the horizontal line is parallel to the previously attached row along the bottom edges. Numerous devices have been utilized in the past to expedite the alignment so that the worker with a hammer and nails or staple gun can get the shingle layer to be applied perfectly aligned before fastening with the nails or staples. U.S. Pat. No. 4,541,217 issued to Stewart Sep. 17, 1985 shows a double row shingle alignment fixture. The device is quite complex and includes several panels, slots, and hinges which do not greatly expedite the job. U.S. Pat. No. 5,018,279 issued to Williams May 28, 1991 shows a strip shingle alignment tool that includes a 90° edge that fits flush against the shingles and a spring actuated manual clamp that provides for clamping along the previously attached row of shingles. This requires manual actuation of two clamps, with the additional time of alignment, and then the expectation that hammering or stapling the current shingle row will not move the alignment tool to the wrong position. Thus, the tool is itself time consuming when utilized for shingle alignment.

U.S. Pat. No. 4,183,144 issued to Barnett Jan. 15, 1980 shows yet another variation on the strip shingle alignment fixture that includes a mechanical clamp for holding it in position. This again requires the additional time of alignment using the manual clamp, and then avoiding any contact that could jar or move the alignment tool during the process of attaching or nailing shingles. Because of the position of the tool, the fact that the roof layer has to physically be positioned adjacent or near the tool can result in accidental brushing against the tool, causing the alignment to become erroneous.

The present invention overcomes the problems shown in the prior art by eliminating a manually actuated clamp or clamps and providing an alignment tool that allows the shingle applicator to physically pull the alignment tool in position while the shingle applicator is actually attaching the shingles with hammer and nail or staple gun or a nail gun. This is accomplished by employing a kneeling board in conjunction with a premeasured pair of brackets having a measuring flange which can be quickly and easily installed with the shingles attached and readily moved for the next alignment position.

SUMMARY OF THE INVENTION

An alignment tool to allow a shingle installer to accurately align square shingles to be attached to a roof with shingles already fastened to the roof, comprising a rigid, narrow, elongated, knee supporting platform that includes a rigid member such as a board sized for receiving the knee of a shingle installer. A knee pad mounted on top of the rigid platform for receiving a shingle installer's knee is also provided wherein the rigid platform includes a top straight leading edge, and a pair of rigid brackets extending downwardly from the rigid platform and attached thereto. The rigid brackets each have a small lip at the distal end relative to the rigid platform, with the distance between the lip end of the rigid brackets to the leading edge of said platform being sized to insure alignable manual registration between the bottom flat straight edge of the attached shingle and the bottom straight shingle edge of the shingle to be attached.

By utilizing the kneeling platform and a kneeling pad for the comfort of the shingle installer, and by eliminating unnecessary manual clips, the unit can be quickly put into position with the inside flange edges flush and in contact with the bottom lower edges of the shingles with each flange on each side of the platform providing two point straight alignment relative to the fastened shingles. Kneeling pressure is then applied from the weight of the shingle installer, firmly holding the alignment tool in position, while at the same time allowing the hands of the shingle installer to be free for manipulation of the hammer and nail, stapler, or nail gun.

The device may be utilized by two shingle installers simultaneously such that it could be 8 ft. long and include two knee pads so that the installers could work in unison while fastening large, long strips of shingle.

The elongated bracket, which includes a 90° lip at one end, has a lip thickness that is approximately the thickness of the shingle for perfect engagement and alignment when the bracket and lip are snugly adjacent the lower edge of the attached shingle for alignment purposes on each end.

The elongated kneeling platform may be constructed of a rigid wooden or plastic board such as a 1×4 that can be anywhere from 4 ft. in length to 8 ft. in length. The top upper edge, which must be straight to provide proper alignment registration when the shingle to be attached is placed flush with the upper edge of the device, may be straight of itself or may include a metal or rigid plastic edge that is premeasured and insured properly straight for the job relative to the brackets which are attached to one side of the elongated platform for alignment of the shingles.

To operate the device with a single shingle installer, the installer moves the alignment tool for registration and flush contact between the bracket end lips at the base of the lower edges of the shingles that have already been attached by hand on the edge of the roof. This is done also in conjunction with the relative position along the roof where the new row of shingles is to be fastened. Once the tool has been put in place, then the bottom edge of the shingles to be attached are put in flush registration with the upper edge of the tool. The installer is thus kneeling on the tool and has his hands free to insure the proper alignment of the shingles to be fastened.

Once aligned, the shingles can then be nailed, either with a hammer or nail gun, or stapled, while at all times, the installer remains kneeling on the kneeling pad, which firmly holds the alignment tool in place.

Using the alternate embodiment with two installers, an 8 ft. elongated rigid member can be utilized that includes two pads equally spaced apart along the top of the member so that two installers can work together, each kneeling in place while the shingles are fastened, with the tool being immovable because of the weight of the two installers on the device.

The time consuming chore of trying to utilize mechanical clips, going to each clip, removing it from the shingle for properly aligning it, and then trying to avoid contacting the alignment tool has been completely eliminated by the use of the present invention.

It is an object of this invention to provide an improved alignment tool for aligning rows of square shingles on roofs in preparation for fastening of the shingles.

It is another object of this invention to provide a shingle alignment tool, wherein the shingle installer utilizes his body weight to hold the tool in perfect registration while the shingles are fastened to insure proper alignment.

And yet still another object of this invention is to provide a shingle alignment tool that eliminates the use of mechanical, spring-actuated clips and that can be utilized by one or more shingle installers simultaneously for expeditious, yet accurate alignment of shingles to be fastened to a roof.

And yet still another object of this invention is to provide an alignment tool for attaching individual shingle sheets that is non-complex in operation and economical to manufacture.

In accordance with these and other objects which will be apparent hereinafter, the instant invention will now become described with particular reference to the accompanying drawings.

DESCRIPTION OF THE PREFERRED EMBODIMENT

Figure 1:
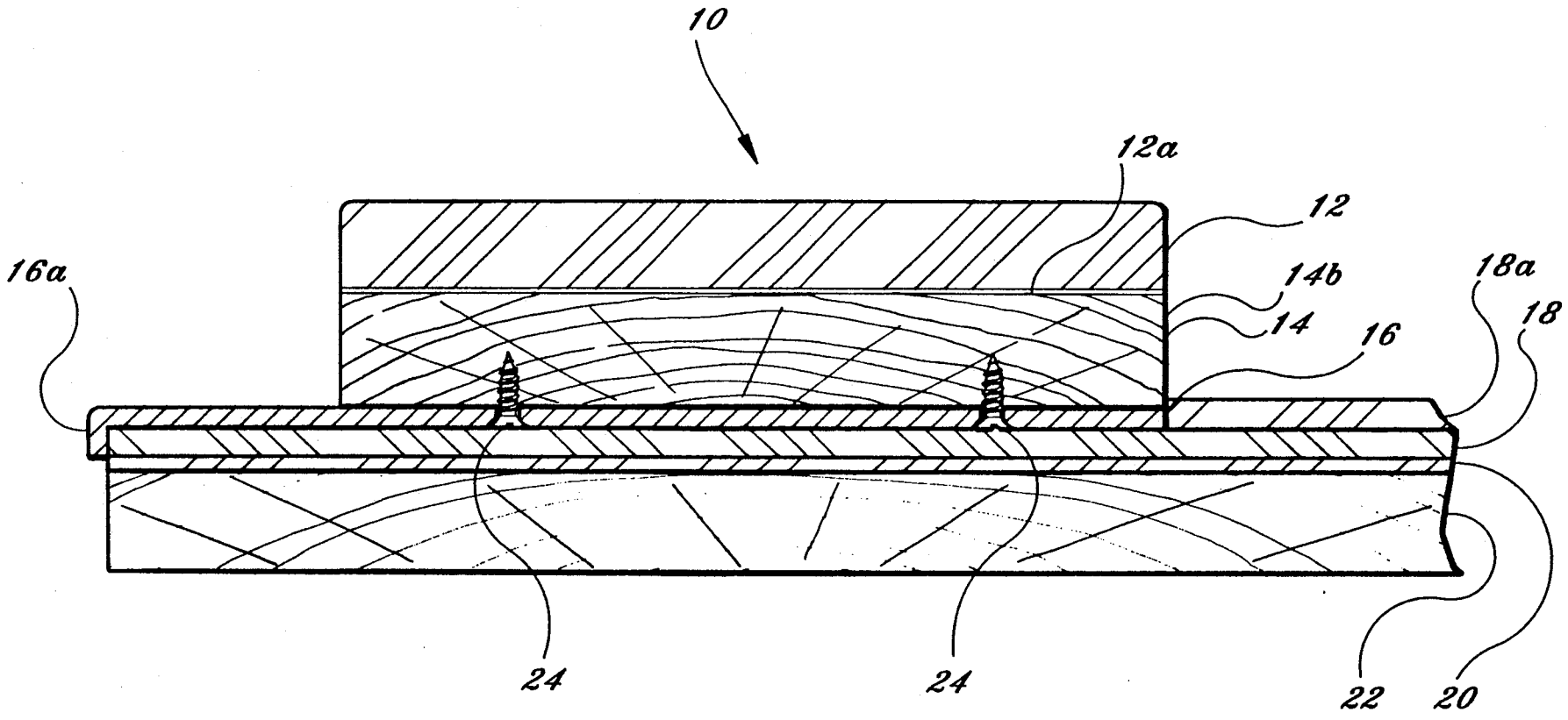
FIG. 1 shows a side elevational view in cross section of the present invention.

Referring now the drawings and in particular, to FIG. 1, a side cross sectional view of the present invention 10 is shown that includes a knee pad 12 which may be a foam pad or other soft or resilient material that is attached to a board 14 which is elongated and may be a 1"×4" in terms of dimensions. The knee pad may be attached by glue 12*a*, which affixes the rectangular knee pad 12 to the top surface of the rectangular shaped board 14. The invention may be used with one or two workers who are employed to install roofing shingles. Using one roofer, the board 14 may be 4 ft. long with a knee pad 1 ft. long positioned near the center of the board so that one person can comfortably kneel on the device.

Attached at each end of the device are a pair of aluminum rectangular elongated brackets 16, which are essentially flat strips of metal that include a 90° lip 16*a* at the distal end away from the portion that is attached by screws 24 which are countersunk so that the screw heads are flush with the bottom edge of bracket 16, with the screws being mounted firmly into board 14, firmly holding each bracket 16 in place. Bracket 16 is also flush with the bottom surface of board 14.

The distance between the distal end of bracket 16 having flange 16*a* to the upper edge 14*b* of board 14 is of a precise length to insure that the shingle 18*a* is properly positioned relative to shingle 18 that has already been fastened to the roof 22. There is a snug registration between the upper edge 14*b* of board 14 and the bottom edge of shingle 18*a* that is to be fastened while the installer kneels on the alignment tool. Typically, a sheet of tar paper 20 has already been attached to the roof 22.

Figure 2:
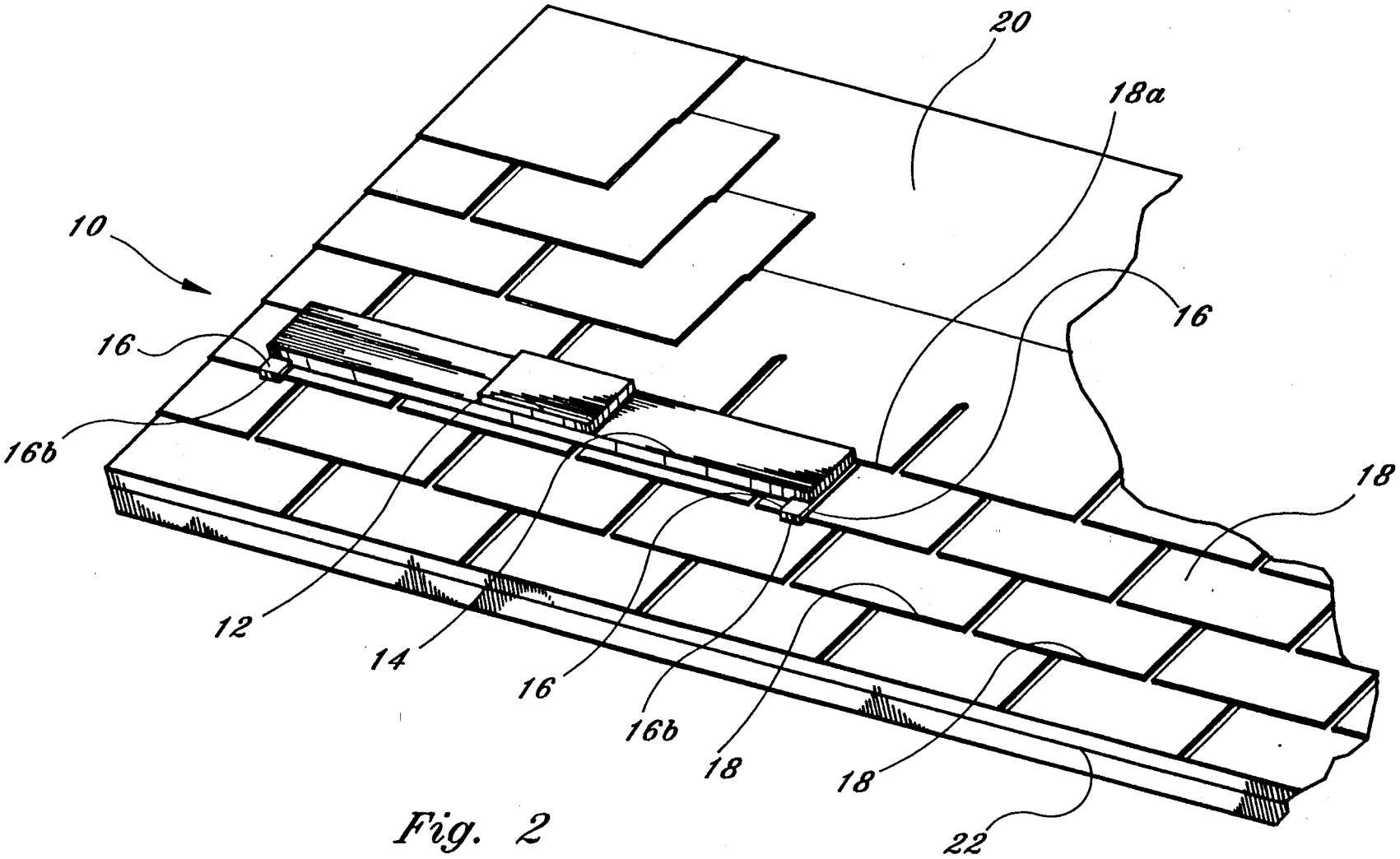
FIG. 2 shows a perspective view of the invention as it would be utilized on a conventional roof for the alignment of shingles.

Referring now to FIG. 2, the present invention 10 is shown as it would be used by a single shingle installer and properly aligned in place with the flanges 16*a* of bracket 16 properly aligned relative to the bottom lower edge of a row of shingles 18 that are already fastened in place. The two brackets 16 are mounted at each end of board 14 with the knee pad 12 substantially aligned in the center of board 14, which in this case may be approximately 4 ft. long. Brackets 16 are attached to the bottom surface of board 14 and are flush and flat to fit firmly and smoothly on top of the shingles 18 that are already fastened to the roof. The upper edge 14*b* of board 14 has been prepared to be perfectly straight and flat so that an unfastened shingle 18*a*, which is a strip horizontally disposed, is then moved flush along the top edge 14*b* of board 14 once the flanges 16*a* are snugly placed against the lower edge of fastened shingles 18. The applicator then kneels on knee pad 12 and is in a perfect position to begin nailing or stapling the unfastened shingles 18*a* which are now perfectly aligned to the roof 22 and to the fastened shingles 18.

Referring back to FIG. 1, note that the length of flange 16*a* is sized to engage the thickness of already fastened shingle 18 so that the leading edge of shingle 18 firmly engages the inside surface of flange 16*a* for a snug fit. This insures proper alignment. If the flange were too long, then the overall bracket 16 would not rest properly along the shingle 18 for true alignment. If the flange 16*a* is too short, it may easily become disconnected by popping up over the shingle 18. Because many shingles are 3/16" in thickness, this is the preferred length for the inside length of flange 16*a*.

Figures 3, 4, 5:
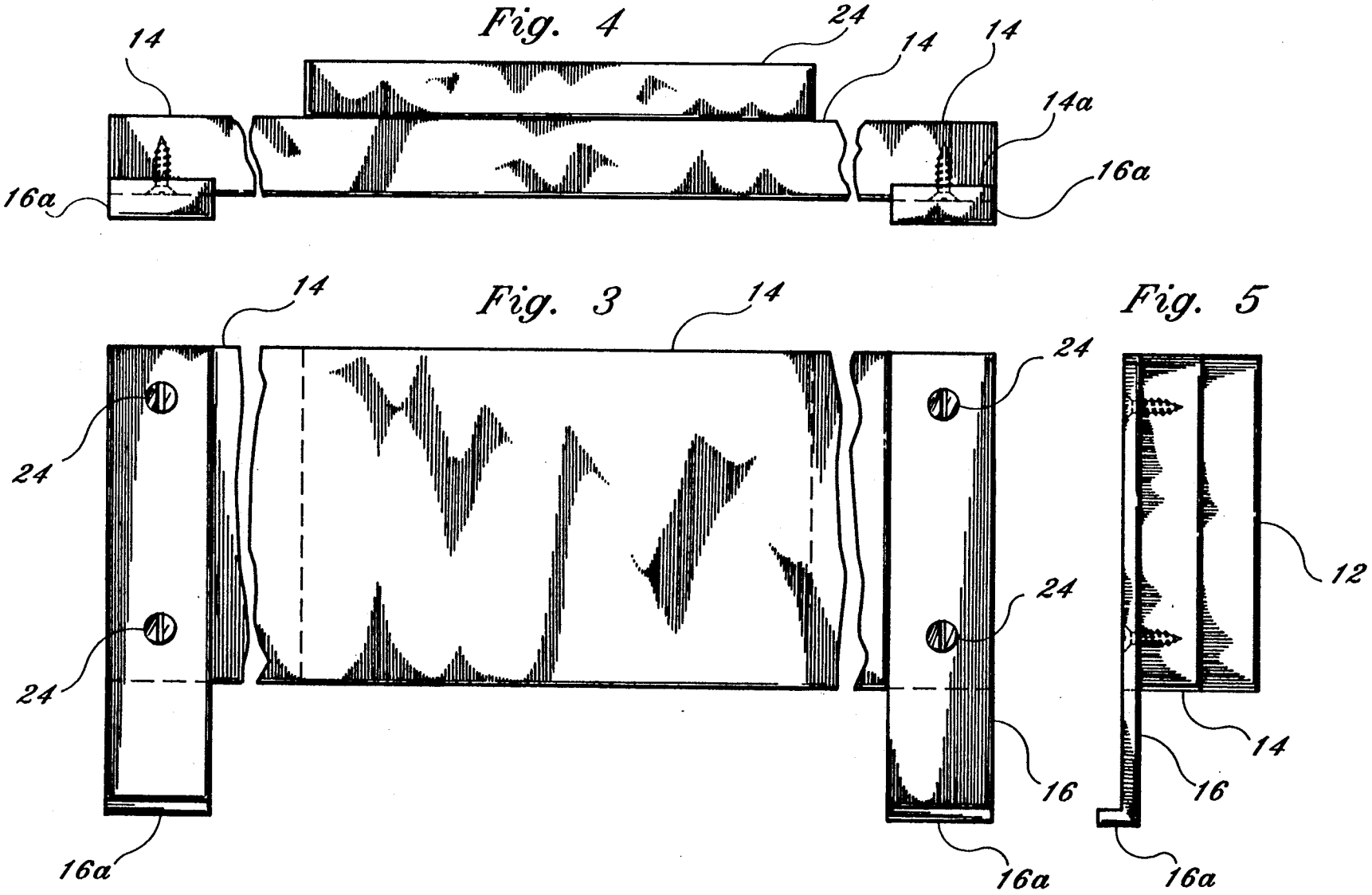
FIG. 3 shows a bottom plan view, partially cut away, of the present invention.
FIG. 4 shows a front elevational view, partially cut away, of the present invention.
FIG. 5 shows a side elevational view of the present invention.

Referring now to FIG. 3, a bottom view of the device is shown with the board length 14 being of indeterminate length with the bracket 16 being flushly mounted into grooves in board 14 and attached by countersunk screws 24 so that the bottom surface is flush. FIG. 4 shows an elevational view with the cushion 12 attached to board 14 and the two brackets 16 and flanges 16*a* mounted adjacent the ends of the board.

FIG. 5 shows a side elevational view with the pad 12 attached to board 14 and the overall bracket 16 with flange 16*a* at the distal end.

The device could include a rigid platform or board 14 that is 8 ft. long and includes two knee pads to accommodate two workers simultaneously.

In conventional shingle application with 5" shingles, the distance from the top edge of board 14, which is edge 14*b*, to the inside edge of flange 16*a* would be 5".

Referring to FIG. 2, when utilizing the present invention, the shingles 18*a* to be fastened are manually moved so that their bottom straight edge contacts and is flush with the upper edge 14*b* of board 14 after the alignment tool 10 has been positioned properly with the flanges 16*a* flush against the lower edge of already fastened shingles 18 with the worker in place kneeling on pad 12. The worker is then in a perfect position to begin nailing or stapling the unfastened shingles 18*a*, which are now perfectly aligned, to the roof 22 and to the fastened shingles 18.

The use of the present invention enables the installer for the first time to eliminate chalk lines and to reach over while kneeling on the alignment tool itself to firmly hold it in place and actually nail or staple the unfastened shingles in place, while at the same time holding the alignment tool with hands free. Clips are eliminated and do not have to be adjusted, readjusted, and manually dealt with. The device is quickly moved for alignment with shingles along the work surface without detachment required.

In summary, the present invention provides a shingle alignment tool that greatly expedites, without decreasing accuracy, the job of attaching shingles to a roof surface.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A shingle alignment tool for aligning a strip of shingles to be fastened to a roof surface relative to a line of shingles already fastened to the roof, comprising:

a rigid, elongated platform capable of receiving human weight, said platform having an alignment surface adapted to abut against a bottom edge of said strip of shingles to be fastened;

a resilient kneeling pad disposed on an upper surface of said rigid platform for comfortably receiving a shingle installer's knee area, wherein kneeling pressure is applied from the weight of the shingle installer, firmly holding said alignment tool in position; and a pair of rigid brackets attached at predetermined points along said rigid platform, said rigid brackets including end flanges sized in length the thickness of a shingle to fit snugly against a shingle at one end, said bracket length and flange location of each of said brackets predetermined in size relative to said elongated platform so that the strip of shingles to be fastened is aligned relative to said elongated platform while the installer kneels on said alignment tool, whereby the shingle installer can fasten the strip of shingles to be aligned to the roof surface while kneeling on the platform, holding the platform in place.

2. An alignment tool as in claim 1, wherein said flange is a 90° lip.

3. An alignment tool as in claim 1, wherein said brackets are flush with a bottom surface of said platform.

4. A shingle alignment tool for aligning a strip of shingles to be fastened to a roof surface relative to a line of shingles already fastened to the roof, comprising:

a rigid, elongated platform capable of receiving human weight, said platform having an alignment surface adapted to abut against a bottom edge of said strip of shingles to be fastened;

a kneeling pad disposed on the top surface of said rigid platform for receiving a shingle installer's knee area, wherein kneeling pressure is applied from the weight of the shingle installer, firmly holding said alignment tool in position while fastening said strip of shingles; and a pair of rigid brackets attached at predetermined points along said rigid platform, each of said rigid brackets including a 90° lip at one end, said lip having a predetermined length that is approximately the thickness of a shingle, such that a leading edge of said shingle firmly engages an inside surface of said lip for a snug fit, said brackets having a proximal end and a distal end, wherein the length from said distal end having said lip to an upper edge of said platform is of a precise length to insure that a shingle to be fastened is properly positioned relative to a shingle that has already been fastened, wherein there is a snug registration between said upper edge of said platform and a bottom edge of said shingle to be fastened while the installer kneels on said alignment tool.

* * * * *